US005224672A

United States Patent [19]

Testart

[11] Patent Number: 5,224,672

[45] Date of Patent: Jul. 6, 1993

[54] TRACK APPARATUS FOR RAILROAD VEHICLES HAVING TIRED WHEELS AND MEDIAN GUIDE ROLLER

[75] Inventor: Gérard Testart, Strasbourg, France

[73] Assignee: Cogifer - Compagnie Generale D'Installations Ferroviaires, Croissy Sur Seine, France

[21] Appl. No.: 831,571

[22] Filed: Feb. 4, 1992

[30] Foreign Application Priority Data

Feb. 5, 1991 [FR] France ..... 91 01277

[51] Int. Cl.[5] ..... E01B 7/00; E01B 25/28

[52] U.S. Cl. ..... 246/415 R; 246/435 R; 104/130; 104/195

[58] Field of Search ..... 104/130, 195; 246/415 R, 417, 418, 419, 435 R, 442, 453

[56] References Cited

U.S. PATENT DOCUMENTS

| | | | |
|---|---|---|---|
| 795,232 | 7/1905 | Pflieger | 104/195 |
| 816,308 | 3/1906 | Farmer | 246/419 |
| 816,646 | 4/1906 | Connett | 104/195 |
| 820,406 | 5/1906 | Flugan, Sr. | 246/385 |
| 915,857 | 3/1909 | Healy | 246/267 |
| 1,009,149 | 11/1911 | Johnson | 246/267 |
| 1,721,460 | 7/1929 | Mariman | 246/435 R |
| 1,788,622 | 1/1931 | Gillispie | 246/435 R |
| 3,019,741 | 2/1962 | Bishop et al. | 104/104 |
| 3,593,668 | 7/1971 | Adams | 104/130 |
| 4,032,095 | 6/1977 | Ferbeck et al. | 246/442 |
| 4,090,452 | 5/1978 | Segar | 104/130 X |
| 4,924,776 | 5/1990 | Uttscheid | 104/130 |
| 4,953,814 | 9/1990 | Oswald et al. | 246/382 |
| 4,970,962 | 11/1990 | Burg et al. | 104/130 |

FOREIGN PATENT DOCUMENTS

| | | | |
|---|---|---|---|
| 330238 | 8/1989 | European Pat. Off. | 246/435 R |
| 23508 | 12/1882 | Fed. Rep. of Germany . | |
| 445545 | 11/1912 | France . | |
| 910725 | 5/1945 | France . | |
| 2307689 | 11/1976 | France . | |

*Primary Examiner*—Frank E. Werner
*Assistant Examiner*—Scott L. Lowe
*Attorney, Agent, or Firm*—Wenderoth, Lind & Ponack

[57] ABSTRACT

An apparatus includes running surfaces made from metallic I-beams one of the flanges of which is adapted to support tires, whereas the web is adapted to receive flat strips which are substantially perpendicular to the web. At least one of the flanges is adapted to receive stiffening flat strips which are substantially parallel to the web. Troughs made from a metallic U-section channel are adapted to be fixed at least partly to one of the flat strips and flanges and open toward the flange adapted to support the tires. Such flanges, web, flat strips and channel are united to constitute a formwork into which is poured concrete whose level is flush with the level of the flanges.

3 Claims, 10 Drawing Sheets

TRACK APPARATUS FOR RAILROAD VEHICLES HAVING TIRED WHEELS AND MEDIAN GUIDE ROLLER

BACKGROUND OF THE INVENTION

The present invention relates to railroad transportation and more particularly that which employs vehicles on wheels equipped with pneumatic tires and provided with a median guide roller and which employs track apparatuses comprising, in addition to running surfaces for the circulation of the tired wheels, a central guide groove for a roller steering the vehicles when passing through a railroad switch.

It is known that track apparatuses of conventional type are industrial products essentially manufactured from rails and that the track is conventionally laid on ballast. The rails are therefore laid and fixed and mounted on ties, most often made from wood which determine the distance between the lines of rails and the desired inclination and which transmit to the ballast the loads supported by the rails.

Special track apparatuses for the circulation of vehicles mounted on tired wheels and equipped with a guide roller for ensuring the deviation of the vehicle when changing direction, for example of the type named LAV (Light Automatic Vehicles), have been designed for conventional mounting on wooden ties, with possible interposition of soleplates or plates, a roller guide groove or device and running surfaces which are most often made from I-section steel beams, whereas in practice the laying of the concerned specific track and the apparatuses associated therewith is in no way conventional. On the contrary, this equipment is laid on a concrete slab which is cast in track apparatuses around the ties which disappear approximately to the extent of about two thirds of their height. Accordingly, such arrangement imposes a modification in the reinforcements and the ironwork of the concrete of the slab in such region.

SUMMARY OF THE INVENTION

An object of the invention is to provide a track apparatus for a railroad system employing vehicles on tired wheels and guided by a median roller, which is laid without ties so as to ensure a greater homogeneity of the reinforced concrete slab and which employs such slab for directly anchoring therein various sub-assemblies which make up the apparatus.

Another object of the invention is to provide such a track apparatus with running surfaces which optimise the use of mechanical industrial methods and public works methods while preserving separation between the superstructure of the apparatus and the slab so as to permit the dismantling of the superstructure and its possible replacement.

The invention provides a track apparatus for railroad installations employing vehicles on wheels equipped with pneumatic tires and provided with a median guide roller, such apparatus comprising running surfaces for the circulation of the tired wheels, a central guide groove for the roller for steering the vehicles when passing through a switch, and troughs closed at least locally by covers for ensuring the continuity of the running surfaces in the turning out or crossing regions of the running surfaces. This apparatus is characterized in that it comprises running surfaces made from metallic I-beams, one of the flanges of which is adapted to support the tires, whereas the web is adapted to receive flat strips substantially perpendicular to said web. At least one of the flanges is adapted to receive stiffening flat strips which are substantially parallel to the web. Troughs made, if need be, from a U-section metallic channel are adapted to be fixed at least partly to one of the flat strips and flanges, and open adjacent to the flange adapted to support the tires. The flanges, web, flat strips and trough are interconnected so as to form a formwork into which concrete is poured, the level of the poured concrete being flush with that of the flanges.

The track apparatus of the aforementioned type, may be constructed in particular in sub-assemblies, by the following steps:

constructing and shaping beams, flat strips and channels to be assembled, welding the beams, flat strips and channels so as to constitute a formwork, turning upside down the beams, flat strips and channels interconnected by welding, laying the beams, flat strips and channels on a planar surface, pouring concrete into the formwork up to the level of the flanges, allowing the concrete to set, turning over the composite iron-concrete apparatus thus obtained which is ready to be installed at a site of use.

BRIEF DESCRIPTION OF THE DRAWINGS

Further features of the invention will appear from the following description and claims and from the accompanying drawings which are given solely by way of example and in which:

DETAILED DESCRIPTION OF THE INVENTION

Figure 1:
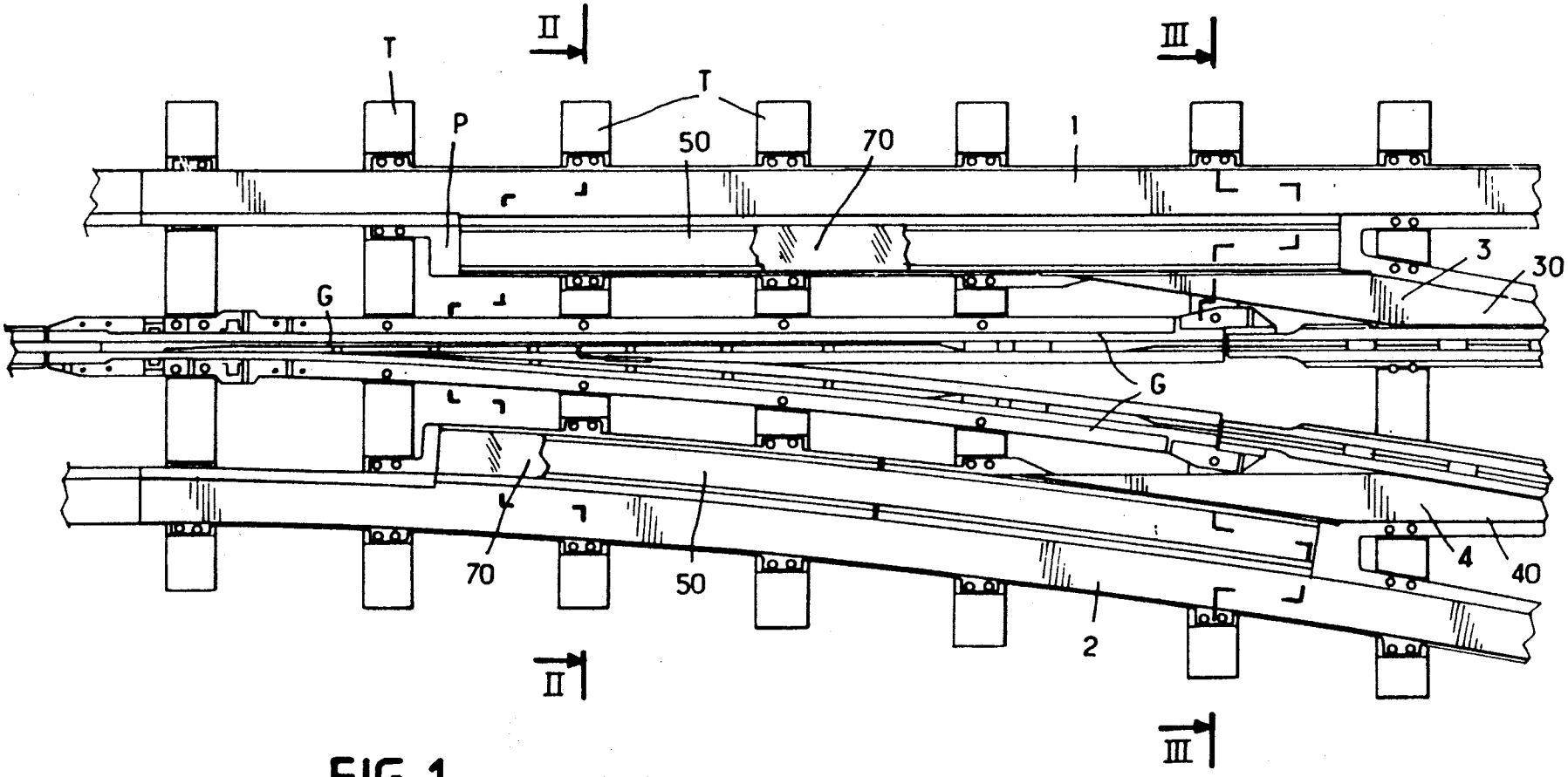
FIG. 1 (PRIOR ART)
FIGS. 1, 2 and 3 are different views of a track apparatus of the switch or points type according to the prior art.

Track apparatuses for railroad installations of the type which concerns the invention are well-known in the art. This is why there will only be described and illustrated that which directly or indirectly concerns the invention. For the rest, those skilled in the considered art will draw from available current conventional solutions for solving particular problems which may be encountered.

Hereinafter, the same reference numeral always identifies the same homologous element whatever the embodiment or alternative.

For convenience of description, each of the constituents of the invention will be described before explaining the method of manufacture.

Figure 2:
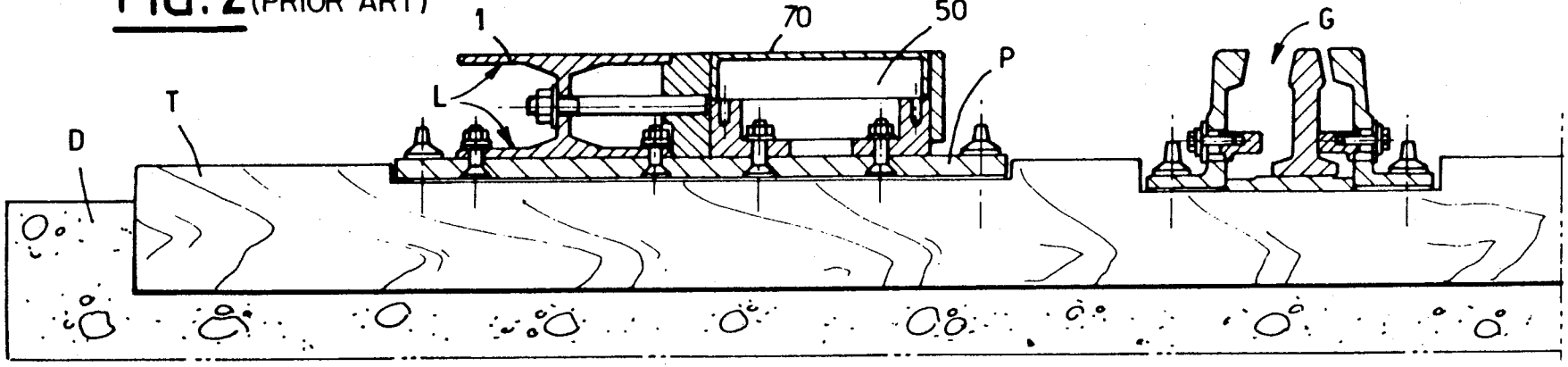
FIG. 2 (PRIOR ART)
Figure 3:
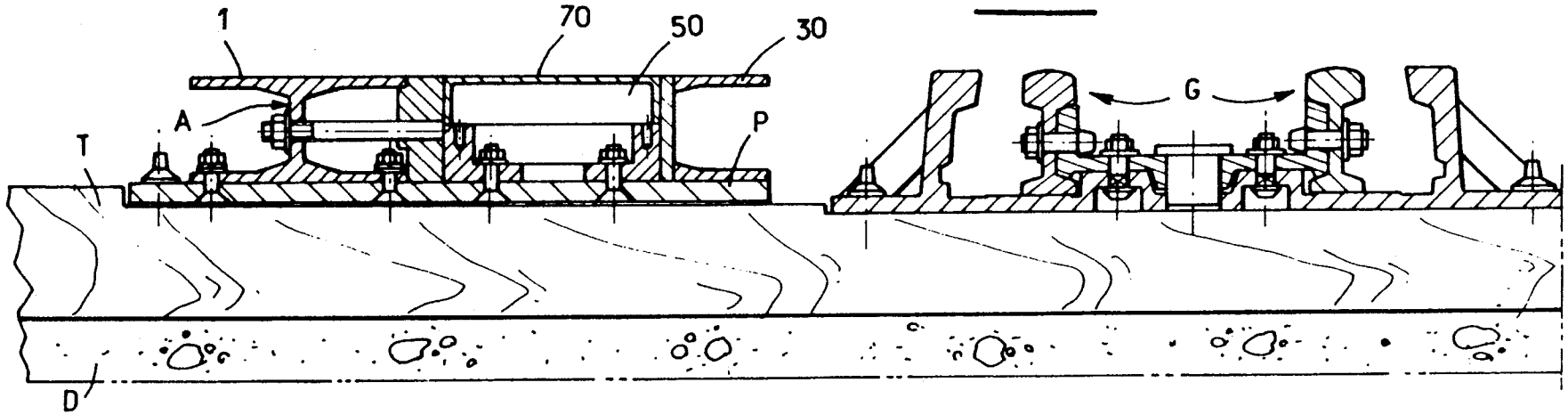
FIG. 3 (PRIOR ART)

An embodiment at present known in the art is shown in plan in FIG. 1 and in partial sectional views in FIGS. 2 and 3 taken on lines II—II and III—III respectively of FIG. 1.

Shown in FIG. 1 are wooden ties or sleepers T, a central guide device or groove G, running surfaces 1 and 3 on the left, and 2 and 4 on the right. The running surface 1, which is rectilinear in this particular instance, is constituted by an I-beam and has no discontinuity; it can be likened to a straight counter-point of a conventional switch of a conventional railroad track. The running surface 2, which is curved in this instance, is constituted also by an I-beam and has no discontinuity; it can be likened to a curved counter-point of a current switch. The running surfaces 3, on the left, and 4, on the right, can be likened to a curved and straight point respectively of a current switch, apart from guiding. The running surfaces 3 and 4 are discontinuous and comprise a plurality of elements, namely respective fixed elements 30 and 40 constituted by I-beams, and removable elements 70, such as covers of troughs 50. FIGS. 2 and 3 show a concrete slab D and the trough 50 which is fixed to the beam of the running surface 1. The design of such a trough meets two requirements, i.e. to act as a support for the covers 70 which locally prolong the running surfaces and to permit the passage of cables and other like electric conductors required for controlling or propelling the vehicles. The running surface-trough assembly is laid by means of a plate (P), for example, as illustrated.

In the conventional manner, "switch" designates a turnout or fork in a line of rails or running surfaces of the same hand and "frog" an intersection of two lines of rails or running surfaces of opposite hands. The words "point", "heel", and "heart" have their special meanings in the railroad art, in the same way as the word "hand".

It is known that concrete running surface structures also exist for track apparatuses intended for the circulation of guided vehicles of this type, which have the drawback that an apparatus cannot be replaced without destruction of the apparatus itself.

Figure 4:
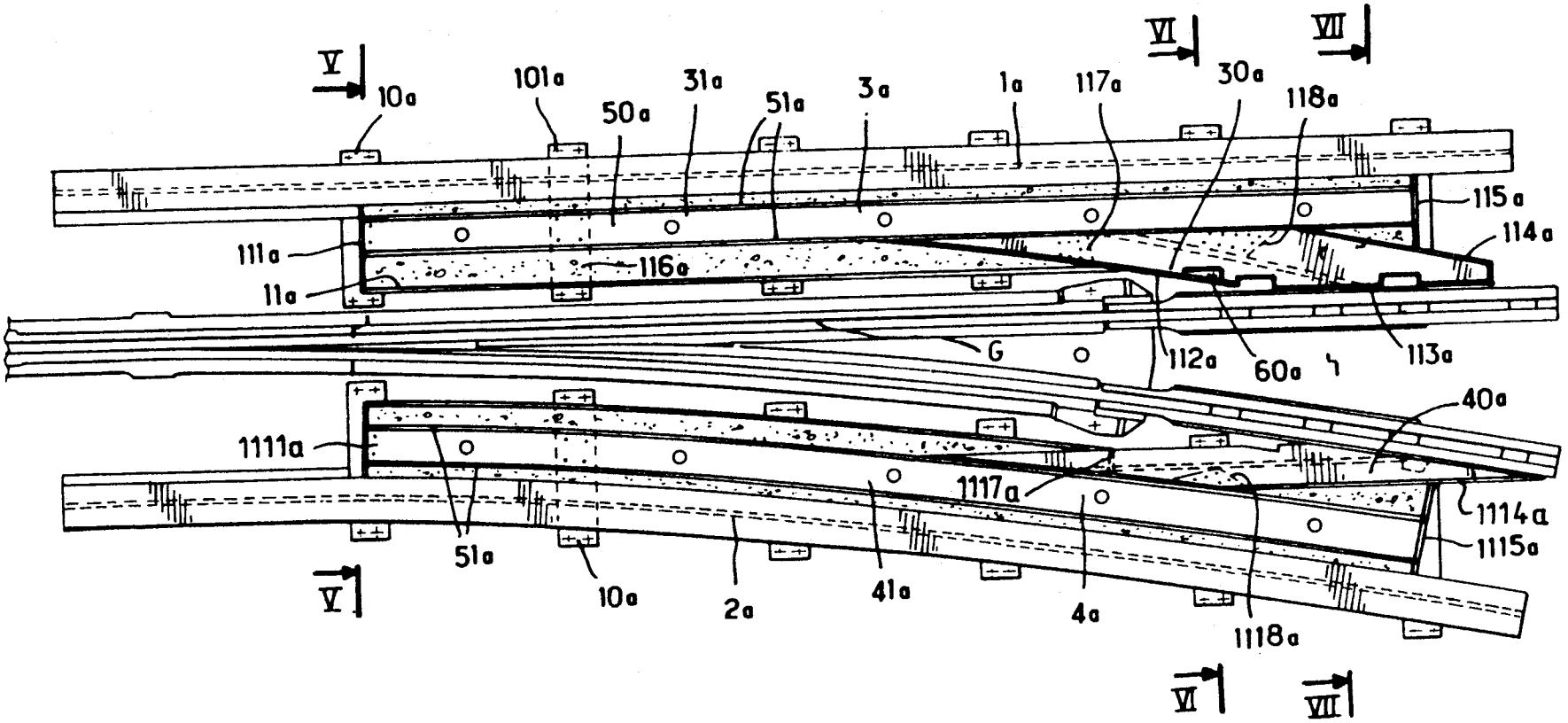
FIGS. 4, 5, 6 and 7 are different views of an embodiment of a track apparatus according to the invention and, more particularly, of its "switch point" sub-assembly.
Figure 5:
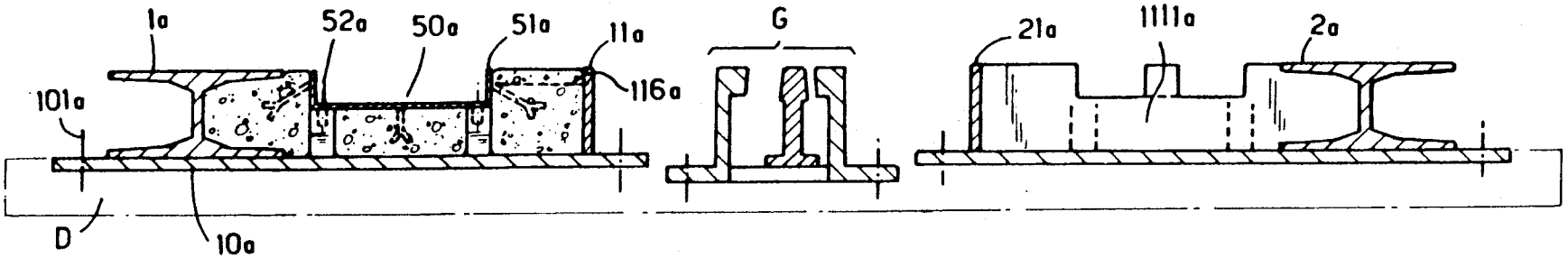
Figure 6:
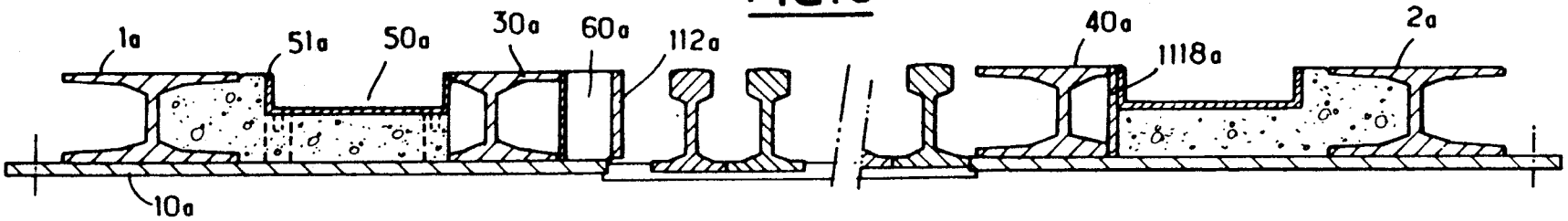
Figure 7:
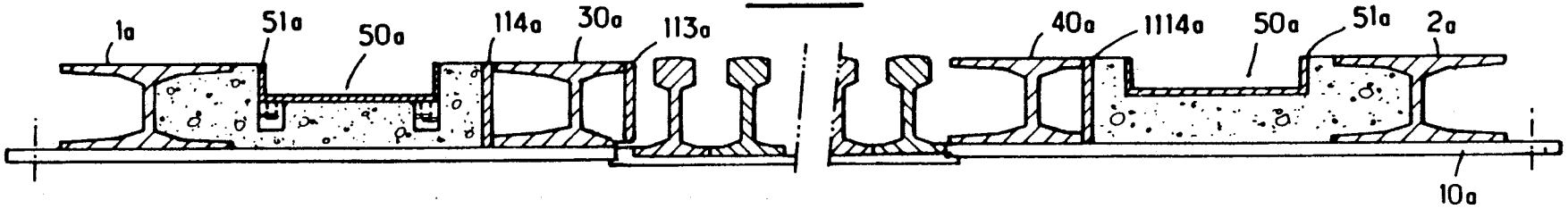

Reference will be made to FIG. 4 which shows in plan a switch or points of a track apparatus according to the invention, and to FIGS. 5, 6 and 7 which are sectional views taken on lines V—V, VI—VI, and VII—VII, respectively, of FIG. 4.

There is shown for example in FIG. 4, in the left sub-assembly relative to the point of the apparatus, a metallic continuous running surface 1*a*, rectilinear in this instance, constituted by a metallic I-beam whose web is employed as the vertical outer upright of a metallic formwork for receiving concrete. An inner vertical upright of this formwork is constituted by a vertical flat strip 11*a* which is connected to a metallic running surface element such as a plate 10*a*; the ends adjacent to the "point" and adjacent to the "heel" of the formwork are constituted by vertical flat strips 111*a* and 115*a* respectively. Within this formwork, a U-section channel 51*a* for being embedding in the concrete will receive covers constituting a part of the running surface; the other part of the running surface is composed of steel or concrete. The assembly is placed on plates 10*a* which permit the mounting of the running surface frames of the sub-assembly thus formed on the slab.

The plates 10*a* are preferably composed of weldable steel and are provided with apertures 101*a* for fixing them to the slab by means of anchoring bolts (not shown in the drawing). The spacing between the apertures corresponds to the length of the covers.

The running surface 1*a* is continuous and formed by one of the flanges of the I-beam. A part 30*a* of the running surface 3*a* is discontinuous and also formed by an I-beam which is stiffened by vertical flat strips 112*a*, 113*a* and 114*a*; a gap 60*a* allows access to the anchoring bolts.

A part 31*a* of the running surface 3*a* is composite. It comprises regions of concrete and regions formed by covers (not shown in the drawing) resting on the troughs 50*a* delimited by the channels 51*a*. To manufacture this composite part, a metallic formwork is constructed whose side is the web of the I-beam 1*a*. The opposite side of this formwork is formed by a vertical flat strip 11*a* whose height is equal to the height of the I-beams of the running surfaces. This flat strip 11*a* is assembled, preferably by welding, with a vertical flat strip 111*a* adapted to close this formwork adjacent to the "point", and with a vertical flat strip 117*a* which permits closing this formwork onto the web of the part 30*a*. A vertical flat strip 118*a* connects the web of the part 30*a* to the stiffening flat strip 114*a* which laterally closes this formwork adjacent to the "heel". A flat strip 115*a* which connects the web of the running surface 1*a* to the stiffening flat strip 114*a* closes this formwork at the end. Disposed inside this formwork is a trough 50*a* constituted by a channel 51*a* for example made from a flat strip bent into a U-shape. This trough is assembled preferably by welding at the point to the vertical flat strip 111*a* and at the heel to the vertical flat strip 115*a*. Vertical stiffeners 116*a* connect the trough to the vertical flat strip 11*a*.

This trough further comprises cavities 52*a* for fixing the covers constituting the running surface; these cavities moreover act as supports for the troughs 50*a* in the region of the plates to which they are welded. These troughs further comprise preferably water discharging openings (not shown in the drawing).

The right sub-assembly comprises the continuous running surface 2*a*, and the discontinuous running surface which comprises the parts 40*a* and 41*a*. The method for constructing the right sub-assembly is identical to that for the left sub-assembly. Vertical flat strips 1111*a*, 1114*a*, 1115*a*, 1117*a*, 1118*a* which delimit a formwork perform the same function as the vertical flat strips 111*a*, 114*a*, 115*a*, 117*a*, 118*a*. The various elements making up this semi-switch are fixed to the plates 10*a* preferably by welding but may also be fixed thereto by any other suitable method.

Figure 8:
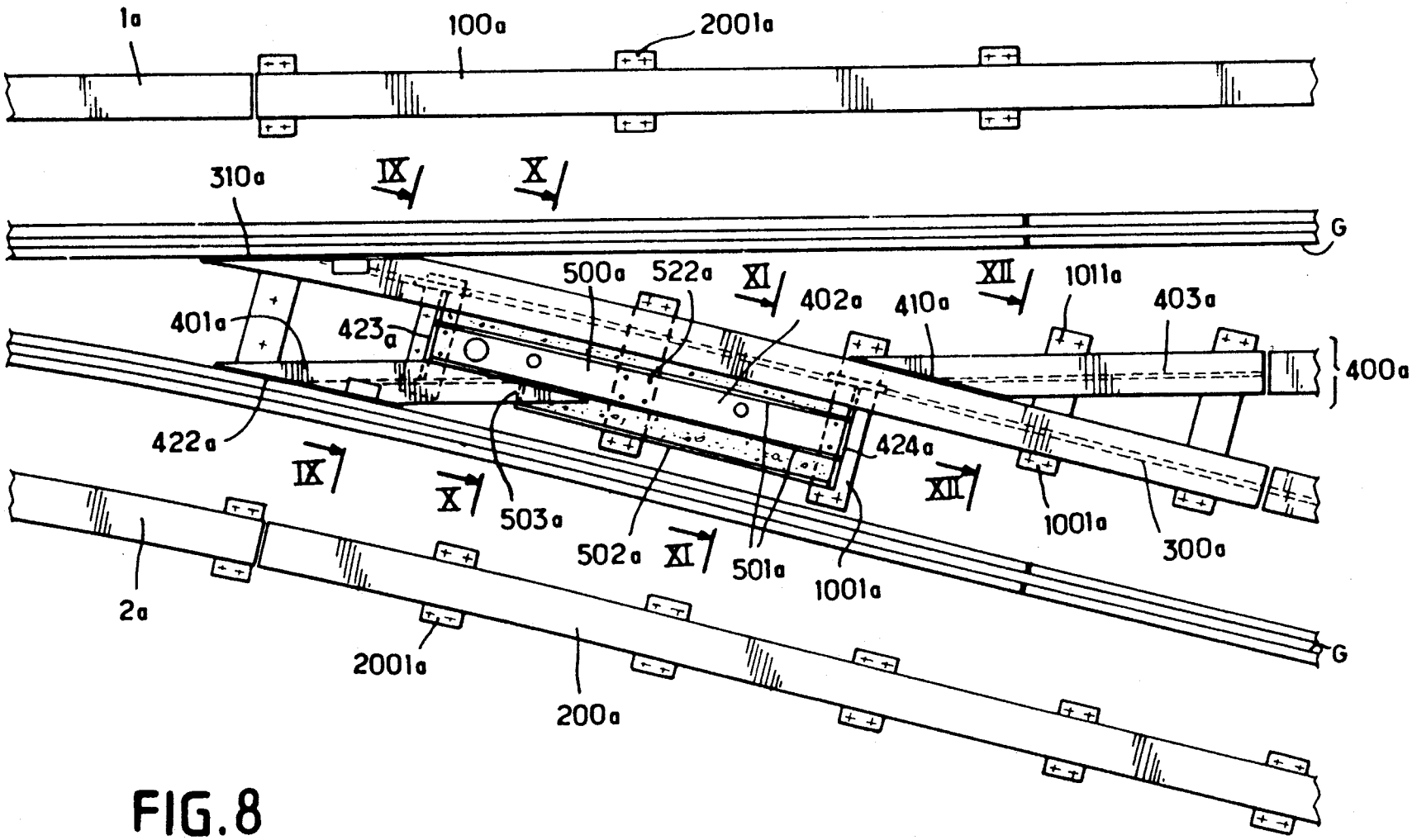
FIGS. 8, 9, 10, 11 and 12 are different views of the same embodiment and more particularly of its "frog" sub-assembly.

The procedure for constructing a frog sub-assembly will be understood by referring to FIG. 8 which is a plan view of this frog or crossing, and to FIGS. 9, 10, 11 and 12 which are sectional views taken on lines IX—IX, X—X, XI—XI and XII—XII of FIG. 8.

In FIG. 8 there is shown on the left outer side of the sub-assembly the running surface 101*a* which extends the running surface 1*a*. This running surface is constituted by a metallic I-beam and rests on soleplates 2001*a*. In this case, this element is rectilinear. On the right outer side of the sub-assembly, there is shown the running surface 200*a* which extends the running surface 2*a*. It is constituted by a metallic I-beam and rests on the soleplates 2001*a*; in this case, this running surface is curvilinear. The running surfaces 100*a* and 200*a* perform the function of the outer rails of a conventional frog.

The heart of the frog proper is seen in the middle. The continuous metallic running surface 300*a*, which is in this case curvilinear, follows on the running surface 3*a*. It is constituted by an I-beam whose web acts as an outer vertical upright of a formwork for receiving concrete. The inner vertical upright of this formwork is formed by a vertical flat strip which is connected to the web of a metallic running surface element 401*a;* the ends of this formwork adjacent to the point and to the heel are formed by vertical flat strips. Inside this formwork, a trough 500*a* delimited by a channel 501*a* which is adapted to be embedded in the concrete, will receive the covers constituting the running surface in its part 402*a;* the elements 401*a* and 403*a* of the running surface 400*a* are of metal; the assembly is placed on plates 1001*a*.

Figure 9:
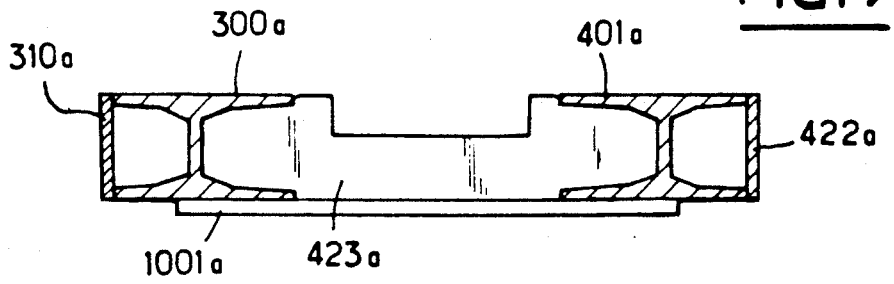
Figure 10:
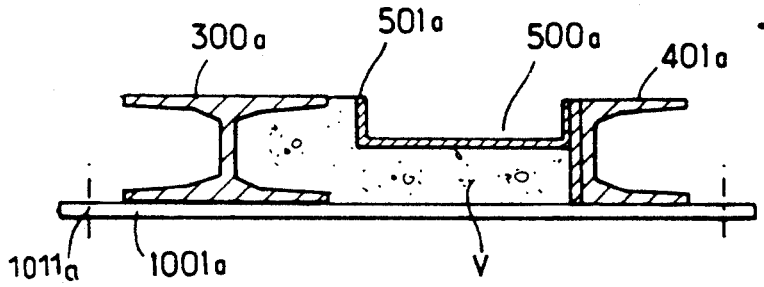
Figure 11:
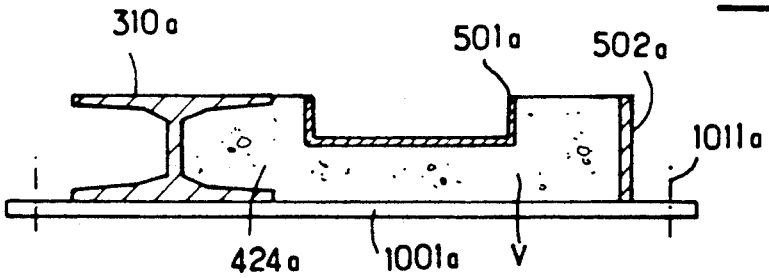
Figure 12:
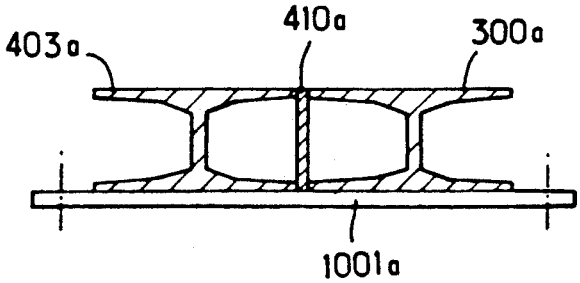

The plates 1001*a* are preferably composed of weldable steel and provided with apertures 1011*a* for fixing them to the slab by means of anchoring bolts (not shown in the drawing). The running surface 300*a*, which is continuous, is composed of an I-beam. It is stiffened adjacent to the point by a vertical flat strip 310*a* (FIGS. 8 and 9). The part 403*a* of the running surface 400*a* is composed of an I-beam and is stiffened at its end adjacent to the point by a vertical flat strip 410*a* (FIGS. 8 and 12). The element 401*a* and part 402*a* form the composite running surface 400*a*. A metallic running surface 401*a* is constituted by the I-beam stiffened by a vertical flat strip 422*a* and regions of concrete and regions made up of covers (not shown in the drawing) resting on the trough 500*a*.

To manufacture this composite sub-assembly, a metallic formwork is constructed.

The inner edge of the formwork is constituted by a vertical flat strip 502*a* extended in turn by a vertical flat strip 503*a* which closes the formwork onto the web of the I-beam 401*a*, adjacent to the point, and onto the vertical flat strip 424*a*, adjacent to the heel, the welding of which to the web of the beam 300*a* terminates the formwork adjacent to the heel. Adjacent to the point, a vertical flat plate 423*a* closes the formwork by connecting the web of the beam 401*a* to the web of the beam 300*a*. Disposed inside this formwork is the trough 500*a* constituted by a sheet 501*a* folded into a U-shape. This channel is preferably assembled by welding to the vertical flat strips 423*a* and 424*a*. The trough 500*a* has orifices 522*a* providing access to the anchoring bolts. Tubes defining these orifices moreover constitute, if need be, supports for the trough. Covers (not shown in the drawing) close the trough 500*a* so as to constitute the running surface.

The mechanical sub-assemblies for manufacturing the right half-switch, the left half-switch and the crossing proper having been constructed in this way, the second prefabricating stage consists in completing the composite sub-assemblies by pouring concrete of suitable quality into the formworks.

To carry out this stage, the formwork thus constructed is turned upside down and the running surface of the sub-assemblies, defined by the flanges of the beams, is placed on a planar surface (of wood, sheet metal or any other suitable material) which is used as a formwork bottom, and then concrete is poured into the volumes V defined by the formwork and levelled off at the lower level of the surface of the other flanges of the I-beams (FIGS. 5 and 10 for example), which becomes the upper side after having turned over the formwork.

The assembly which constitutes the track apparatus made from right and left running surfaces, semi-switches, the crossing and the guiding device or groove, is positioned on the site in height, plan and spacing in its final position before pouring the slab proper. The slab is poured up to the lower level of the plates.

Figure 13:
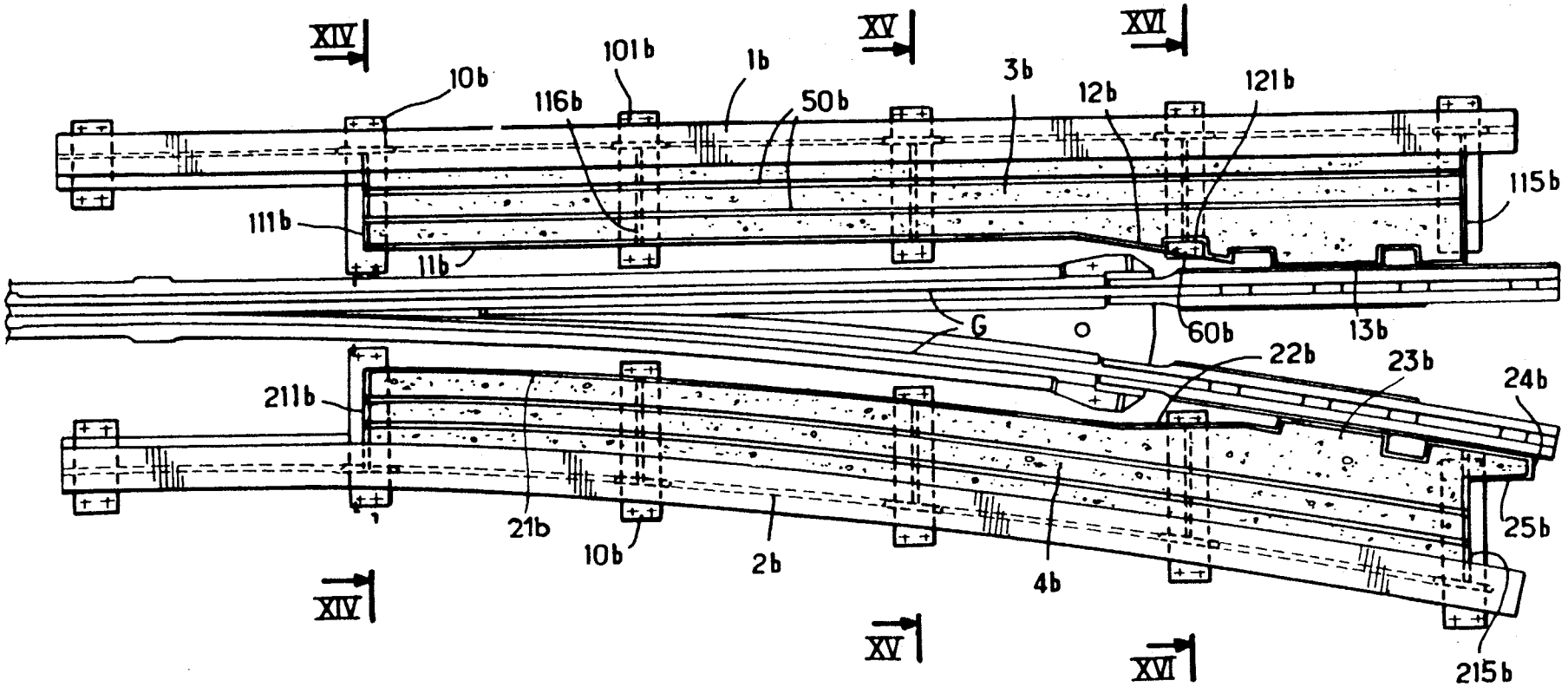
FIGS. 13, 14, 15 and 16 are different views of another embodiment of the track apparatus according to the invention and, more particularly, of its "switch point" sub-assembly.

Reference will now be made to FIG. 13 which is a plan view of another embodiment of the invention. There is for example seen in the left sub-assembly with respect to the point of the track apparatus, a metallic continuous running surface 1*b* which is rectilinear in the case of this Figure and constituted by an I-beam whose web acts as an outer vertical upright of a formwork for receiving concrete for constituting a running surface 3*b*. The formwork of the running surface is defined on the inner side and at the ends by vertical flat strips, and troughs required for the passage of electric cables are formed when pouring the concrete of the running surface. The assembly is placed on plates.

Figure 14:
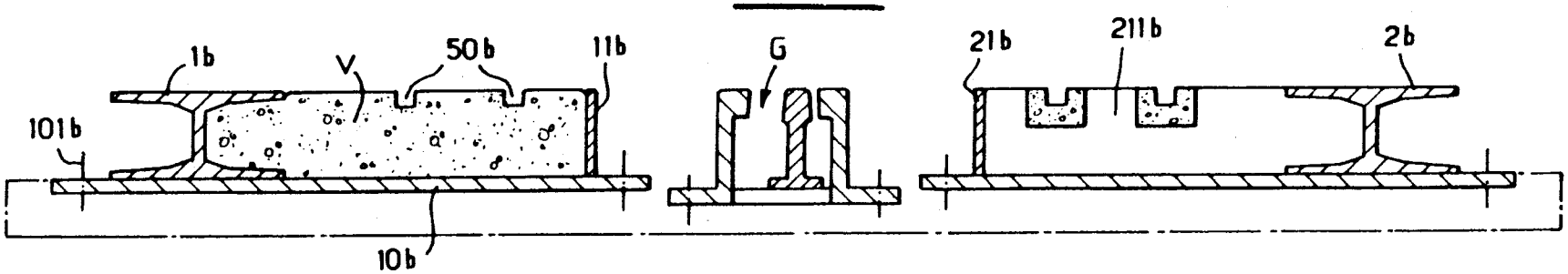
Figure 15:
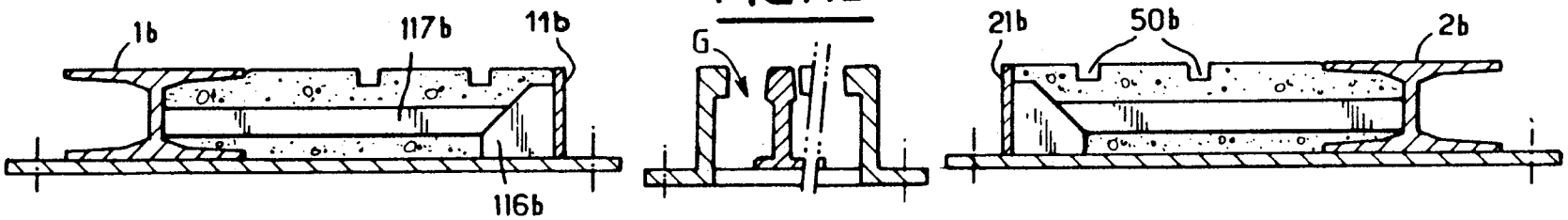
Figure 16:
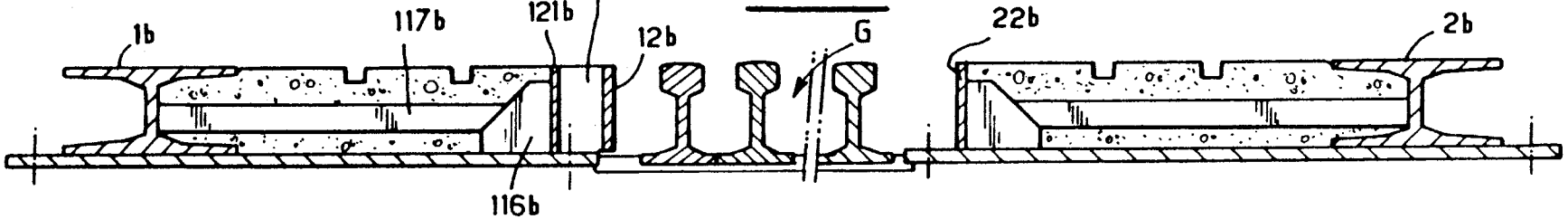

This embodiment is described more precisely with reference to FIG. 13 and to FIGS. 14, 15 and 16 which are sectional views taken on lines XIV—XIV, XV—XV and XVI—XVI of FIG. 13. The plates 10*b* are preferably composed of weldable steel and provided with orifices 101*b* for fixing them to the concrete slab by means of anchoring bolts (not shown in the drawing). The running surface 1*b* is continuous and is part of an I-beam which is fixed to the plates 10*b* preferably by welding but may also be fixed by bolts or rivets.

The concrete running surface 3*b* is contained in a formwork constituted on one side by the web of the beam 1*b*and on the other side by a vertical, flat strip 11*b* extended by flat strips 12*b* and 13*b*. The two ends of this formwork are formed by vertical flat strips, namely strip 111*b* adjacent to the point and strip 115*b* adjacent to the heel. The flat strip 111*b* is preferably welded to the web of the beam 1*b*, to the plate 10*b* and to the flat strip 11*b*. The flat strip 115*b* is preferably welded to the web of the beam 1*b*, to the plate 10*b* and to the flat strip 13*b* which is welded to the flat strip 12*b*, itself welded to the flat strip 11*b*. The flat strip 11*b* is welded to the plates 10*b*. Stiffeners 117 welded to the web of the beam 1*b* and to bracket plates 116*b* which are welded to the vertical flat strip 11*b* provide in the region of the plates 10*b* a connection between the vertical flat strip 11*b* and the beam 1*b*. A gap 60*b*, defined by a U-section screen 121*b*, provides access to the anchoring bolts.

The right sub-assembly is composed of a metallic running surface 2*b*. The running surface 4*b* is composed of concrete poured into a formwork constituted by vertical flat strips 211*b*, 21*b*, 22*b*, 23*b*, 24*b*, 25*b*, 215*b*. The cable troughs 50*b*are formed when pouring the concrete.

The procedure for constructing this alternative embodiment of the crossing or frog sub-assembly will be explained with reference to FIG. 17 which is a plan view of this crossing, and to FIGS. 18, 19, 20 and 21 which are sectional views taken on lines XVIII—XVIII, XIX—XIX, XX—XX, and XXI—XXI of the FIG. 17.

Figure 17:
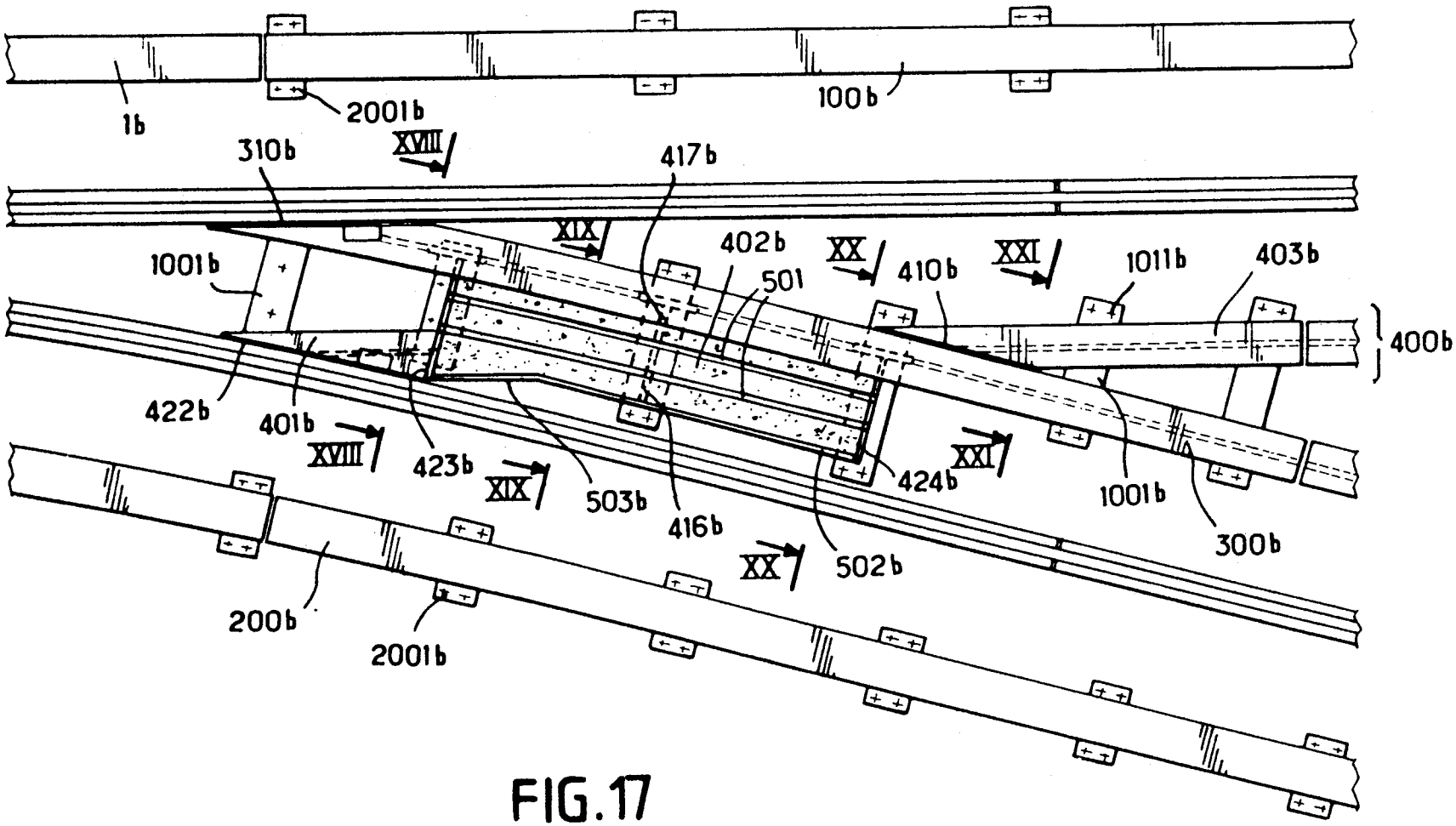
FIGS. 17, 18, 19, 20 and 21 are different views of the second embodiment and, more particularly, of its "frog" sub-assembly.
Figure 18:
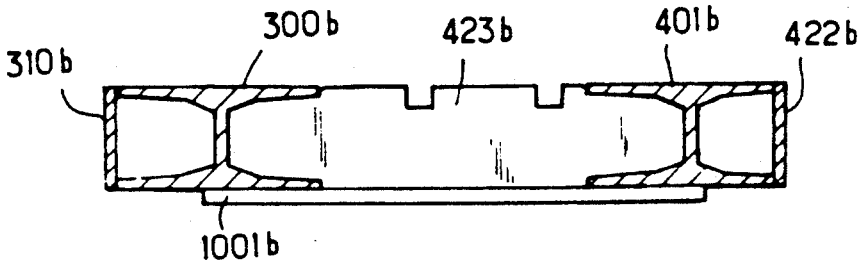
Figure 19:
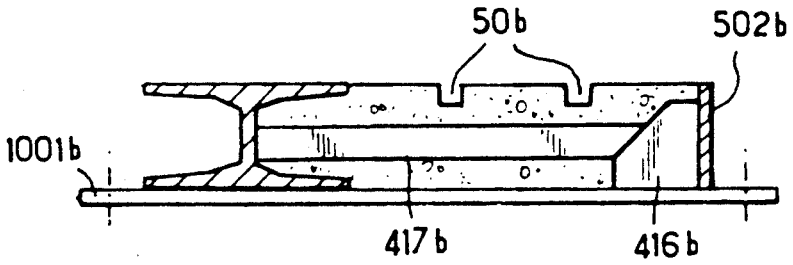
Figure 20:
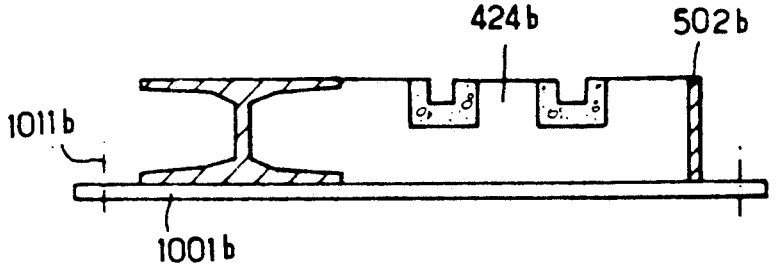
Figure 21:
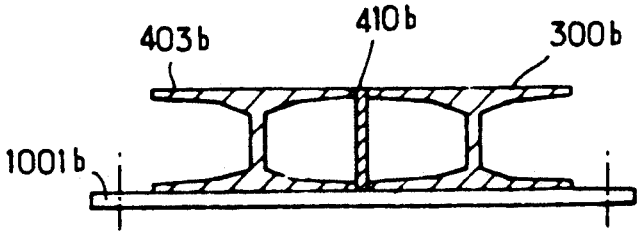

Shown in FIG. 17, on the left outer side of the sub-assembly, is a running surface 100*b* which extends the running surface 1*b*, is constituted by a steel I-beam and rests on soleplates 2001*b*. In the case of FIG. 17, the running surface 100*b* is rectilinear. On the right outer side of the sub-assembly, there is shown a running surface 200*b* which extends the running surface 2*b* and is constituted by a steel I-beam and rests on soleplates 2001*b*. In the case illustrated, the running surface 200*b* is curvilinear. The beams of the running surfaces 100*b* and 200*b* perform the function of outer rails of a conventional frog or crossing.

The frog point proper is seen in the middle. A continuous running surface 300*b*, curvilinear in the case of this arrangement, follows the running surface 3*a*. It is constituted by an I-beam whose web acts as an upright of a formwork for receiving concrete which will constitute the central part 402*b* of a running surface 400*b* which follows the running surface 4*b*. It further comprises elements 401*b* and 402*b*. The formwork of the central part 402*b* is constituted on both sides by vertical flat strips 423*b*, 424*b* perpendicular to the web of the beam 300*b* and an assembly of strips interconnecting the flat strips in question. The assembly is placed on plates.

The plates 101*b* are of weldable steel and provided with orifices 1011*b* which enable them to be fixed to the slab by means of anchoring bolts (not shown in the drawing). The running surface 300*b*, which is continuous and composed of an I-beam, is stiffened at its end adjacent to the point by a vertical flat strip 310*b*. The running surface 300*b* is fixed to the plates 1001*b* preferably by welding but may also be fixed by bolts or rivets. The part 403*b* of the running surface 400*b* is composed of an I-beam and is stiffened at its end adjacent to the point. It is fixed to the plates 1001*b* in the same way as the running surface 300*b*. The part 401*b* of the running surface 400 is composed of an I-beam stiffened at its end adjacent to the point by a vertical flat strip 422*b*. It is fixed to the plates, as are the running surface and the parts 300*b* and 403*b*. The formwork for constructing the part 402*b* of the running surface 400*b* is formed by a vertical flat strip 424*b* having the same height as the I-beam of the running surface, and is welded to the web of the beam of the running surface 300*b* and to the plate 1001*b* on which it bears. This strip constitutes one end of the formwork. The other end of the formwork is constituted by a vertical flat strip 423*b* having the same height as the I-beam of the running surface 300*b*. This flat strip is welded to the web of the beam of the running surface 300*b* and to the plate 1001*b* on which it bears. It is moreover welded to the web and to the flanges of the I-beam constituting the running surface 401*b*. The last side of the formwork is constituted by vertical flat strips 502*b*, 503*b* which are welded to the flat strips 423*b* and 424*b*. A stiffening flat strip 417*b* moreover joins the web of the beam of the running surface 300*b* to a bracket plate 416*b* welded to the flat strip 502*b*.

Troughs 50*b* are produced when pouring the concrete of the part 402*b* of the running surface 400 in its formwork.

The mechanical sub-assemblies permitting the fabrication of the right semi-switch, the left semi-switch and the crossing proper being constructed in this way, the second pre-fabrication stage consists in finishing the composite sub-assemblies by pouring into the formworks thus constructed a concrete of suitable quality and in reserving the place for the troughs 50*b*. To carry out this stage, the part of the track apparatus acting as a formwork is turned upside down and the running surface side of the sub-assemblies defined by one of the flanges of the beams is placed on a planar surface (of wood, sheet metal or any other suitable material) which is used as a formwork bottom. Then the concrete is poured into the volumes V defined by the formworks and levelled off at the lower level of the I-beams (FIGS. 14 and 18 for example), which becomes the upper side after turning over.

The assembly constituting the right and left running surfaces, the semi-switch, the crossing and the guiding device or groove, is positioned on the site in height, plan and spacing in its final position. The slab is poured up to the lower level of the plates.

The entire practical interest of the invention will be understood, since it permits fabricating composite iron-concrete track apparatuses by pre-fabrication of sub-assemblies from metallic components which are, after having been constructed and shaped, interconnected preferably by welding so as to serve at least locally as a formwork for pouring concrete. Such track apparatuses may be brought to the site of use, partly or completely assembled, for direct installation, for example on a concrete slab without however preventing their replacement.

What is claimed is:

1. A track apparatus for railroad installations employing vehicles on wheels equipped with pneumatic tires and provided with a median guide roller, said apparatus comprising running surfaces for the circulation of the tired wheels, a central guide device for the roller for steering the vehicles when passing through a railroad switch, troughs, and covers which are removable for at least locally closing said troughs for ensuring the continuity of said running surfaces in turnout or crossing regions of said running surfaces, said running surfaces being defined by metallic I-beams each having flanges and a web interconnecting said flanges, one of said flanges defining the respective running surface for supporting the tired wheels, said apparatus further comprising flat strips which are substantially perpendicular to said web, stiffening flat strips which are substantially parallel to said web combined with at least one of said flanges, said troughs being made from a metallic U-section channel at least partly fixed to one of said flat strips and said flanges and open toward said one flange for supporting the tired wheels, said flanges, web, flat strips and channel being united so as to constitute a formwork into which is to be poured concrete to a level flush with the level of said flanges.

2. An apparatus according to claim 1, wherein said flanges, web, flat strips and channel are united by welding.

3. An apparatus according to claim 1, composed of sub-assemblies which are pre-assembled and associated before pouring of the concrete.

* * * * *